US012618559B2

(12) United States Patent
Park et al.

(10) Patent No.: US 12,618,559 B2
(45) Date of Patent: May 5, 2026

(54) GAS FURNACE AND AIR CONDITIONER HAVING THE SAME

(71) Applicant: LG ELECTRONICS INC., Seoul (KR)

(72) Inventors: Janghee Park, Seoul (KR); Yongki Jeong, Seoul (KR); Jinwoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 814 days.

(21) Appl. No.: 17/978,536

(22) Filed: Nov. 1, 2022

(65) Prior Publication Data

US 2023/0141194 A1 May 11, 2023

(30) Foreign Application Priority Data

Nov. 5, 2021 (KR) ..... 10-2021-0151810

(51) Int. Cl.

| | |
|---|---|
| ***F23N 1/02*** | (2006.01) |
| ***F24F 1/0033*** | (2019.01) |
| ***F24F 1/009*** | (2019.01) |
| ***F24H 3/06*** | (2022.01) |
| ***F24H 9/20*** | (2022.01) |

(52) U.S. Cl.

CPC ..... *F23N 1/022* (2013.01); *F24F 1/0033* (2013.01); *F24F 1/009* (2019.02); *F24H 3/065* (2013.01); *F24H 9/2085* (2013.01); *F23N 2227/00* (2020.01); *F23N 2229/00* (2020.01); *F23N 2235/24* (2020.01); *F23N 2237/02* (2020.01)

(58) Field of Classification Search

CPC ..... F24N 1/022; F24F 1/009; F24F 1/0033; F24H 3/065; F24H 9/2085

USPC ..... 126/116 A, 99 R, 116 R

See application file for complete search history.

(56) References Cited

U.S. PATENT DOCUMENTS 3,251,406 A * 5/1966 Lauer ..... F24F 3/044 126/117
3,472,907 A * 10/1969 Coberly ..... C10G 9/00 202/241
2017/0176048 A1* 6/2017 Schneider ..... F24H 15/345

FOREIGN PATENT DOCUMENTS

WO WO 2005/095870 10/2005

* cited by examiner

*Primary Examiner* — Vivek K Shirsat
(74) *Attorney, Agent, or Firm* — KED & ASSOCIATES

(57) ABSTRACT

Disclosed are a gas furnace and an air conditioner having the same. The gas furnace includes: a fuel valve; a manifold providing a passage of fuel passing through the fuel valve; a plurality of burners provided to burn fuel provided from the manifold and spaced apart from each other in one direction; a plurality of heat exchangers providing a passage of combustion gas generated by the plurality of burners; and a blower for causing a flow of air passing around the heat exchanger. The manifold includes: a first tube having one end connected to the fuel valve and forming a first passage; a second tube extending in the one direction, forming a second passage, and facing at least one of the plurality of burners; a third tube extending in the one direction, forming a third passage, and facing remaining burners of the plurality of burners; and a three-way valve connected to the first tube, the second tube, and the third tube.

16 Claims, 13 Drawing Sheets

FIG. 10A

| | Max thermal power[Btu/h] | First burner group | Second burner group | total ratio | Required thermal power[Btu/h] | TDR |
|---|---|---|---|---|---|---|
| | | 25% | 25% | | | |
| Number of burners | | 3 | 3 | | | |
| | 100,000 | 12,500 | 12,500 | 25 | 25,000 | 4.00 |
| Per burner | 16,667 | 4,167 | 4,167 | | | |

FIG.10B

| | Max thermal power[Btu/h] | First burner group | Second burner group | total ratio | Required thermal power[Btu/h] | TDR |
|---|---|---|---|---|---|---|
| | | 0% | 25% | | | |
| Number of burners | | 3 | 3 | | | |
| | 100,000 | – | 12,500 | 13 | 12,500 | 8.00 |
| Per burner | 16,667 | – | 4,167 | | | |

GAS FURNACE AND AIR CONDITIONER HAVING THE SAME

CROSS-REFERENCE TO RELATED PATENT APPLICATIONS

This application claims priority to Korean Patent Application No. 10-2021-0151810, filed Nov. 5, 2021, whose entire disclosures are hereby incorporated by reference.

BACKGROUND OF THE DISCLOSURE

Field of the Disclosure

The present disclosure relates to a gas furnace and an air conditioner having the same.

Related Art

In general, an air conditioner refers to an apparatus for cools and heating an indoor space through compression, condensation, expansion, and evaporation of refrigerant. The air conditioner can improve indoor air quality by exchanging indoor unit with outdoor air through a ventilator. In addition, the ventilator may increase the temperature of air supplied to the indoor space by using high-temperature combustion gas of a gas furnace.

International patent application WO 2005-095870 A1 (published on Oct. 13, 2005) discloses a gas furnace in which a plurality of burners are classified into two groups and thermal power of each group is independently controlled.

Specifically, the manifold of the gas furnace is divided into two sections by a separator plate, and each of the two sections communicates with each of the two groups. Also, the gas furnace has a first gas valve for supplying fuel to one of the two sections, and a second gas valve for supplying fuel to the other of the two sections. That is, the above gas furnace independently controls the thermal power of each group using the first gas valve and the second gas valve, and adjusts the thermal power of the gas furnace in stages.

However, this control may require the gas furnace to have at least two gas valves. In this case, compared to a case where the gas furnace is provided with a single gas valve, not only the cost of an added gas valve itself, but also the cost accompanied therewith (that is, the cost of a fuel supply pipe connecting the added gas valve and the manifold, the cost related to a structure for installing the added gas valve in the gas furnace, etc.) are increased.

In addition, an igniter and a flame detector are required for each group of burners in the gas furnace, thereby increasing the cost and leading to inconvenience to control each igniter and each flame detector individually.

In addition, the gas furnace has a difficulty in independently controlling at least two gas valves. In particular, when an air ratio of burners is to be controlled with one inducer, it may be difficult for the inducer to synchronize the air ratio of one group of burners with the air ratio of the other group. In other words, in order for the burners to have a constant air ratio, it is necessary to match an opening degree of a second gas valve corresponding to one group of the burners to an opening degree of a first gas valve corresponding to the other group. In this case, in a case where the first gas valve is a dual stage valve capable of controlling an opening degree in two stages (i.e., open fully (100%) and open in half (50%)), even if the second gas valve is a modulating valve capable of controlling an opening degree to a lower level than the first gas valve, it may be difficult to reduce the opening degree of the second gas valve to 50% or less. That is, it may be difficult for the gas furnace to provide thermal power below a certain level because an opening degree of any one of the independently controlled gas valves is restricted by another valve when all of the burners are operated.

SUMMARY OF THE DISCLOSURE

An aspect of the present disclosure is to solve the above and other problems.

Another aspect of the present disclosure provides a gas furnace capable of providing a user with thermal comfort and reducing heating cost and energy by implementing a high Top Down Ratio (TDR). Here, the TDR refers to a ratio of maximum thermal power to minimum thermal power.

Yet another aspect of the present disclosure provides a gas furnace capable of controlling thermal power in stages in a wide range.

Yet another aspect of the present disclosure provides a mechanism capable of supplying fuel to only some burners using a minimum number of valves in order to implement a thermal power below a reference thermal power.

Yet another aspect of the present disclosure provides various methods for controlling the above mechanism according to a required thermal power.

Yet another aspect of the present disclosure provides a structure capable of minimizing the number of igniters and flame detectors provided in a plurality of burners.

According to one aspect of the present disclosure, there is provided a gas furnace including: a fuel valve; a manifold providing a passage of fuel passing through the fuel valve; a plurality of burners provided to burn fuel provided from the manifold and spaced apart from each other in one direction; a plurality of heat exchangers providing a passage of combustion gas generated by the plurality of burners; and a blower for causing a flow of air passing around the heat exchanger.

According to another aspect of the present disclosure, the manifold may include: a first tube having one end connected to the fuel valve and forming a first passage; a second tube extending in the one direction, forming a second passage, and facing at least one of the plurality of burners; a third tube extending in the one direction, forming a third passage, and facing remaining of the plurality of burners; and a three-way valve connected to the first tube, the second tube, and the third tube.

According to another aspect of the present disclosure, the three-way valve may guides fuel passing through the first passage to flow to the second passage and the third passage or to the third passage.

According to another aspect of the present disclosure, the three-way valve may be positioned between the second tube and the third tube.

According to another aspect of the present disclosure, the plurality of burners may include: a first burner group with burners facing the second tube; and a second burners group with burners facing the third tube.

According to another aspect of the present disclosure, a number of the burners in the first burner group may be equal to a number of the burners in the second burner group.

According to another aspect of the present disclosure, the gas furnace may further include: a plurality of first nozzles connected to the second tube, facing the burners in the first burner group, and spaced apart from the burners in the first burner group; and a plurality of second nozzles connected to the third tube, facing the burners in the second burner group, and spaced apart from the burners in the second burner group.

According to another aspect of the present disclosure, each of the burners of the first group of burners may further include: a venturi portion forming an entry of a corresponding one of the burners in the first burner group; a head portion forming an exit of the corresponding one of the burners of the first burner group; a retainer inserted into the head part; and a holder connected to the venturi portion and having a corresponding one of the plurality of first nozzles inserted thereinto and fixed thereto.

According to another aspect of the present disclosure, the gas furnace may include: a flange connected to the plurality of burners between the plurality of burners and forming a flame propagation port; and a burner box accommodating the plurality of burners and the flange.

According to another aspect of the present disclosure, the gas furnace may further include: an igniter mounted on the burner box and adjacent to an exit of a burner located furthest from the first group of burners among the burners of the second group of burners.

According to another aspect of the present disclosure, the gas furnace may further include: a flame detector mounted to the burner box and adjacent an exit of a burner positioned farthest from the second burner group among the burners in the first burner group.

According to another aspect of the present disclosure, the gas furnace may further include: an auxiliary detector mounted to the burner box and adjacent an exit of a burner positioned closest to the first burner group among the burners in the second burner group.

According to another aspect of the present disclosure, the igniter, the flame detector, and the auxiliary detector may be detachably mounted to the burner box.

According to another aspect of the present disclosure, the plurality of heat exchangers may include: a first heat exchanger group with heat exchangers in communication with the burners in the first burner group; and a second heat exchanger group with heat exchangers in communication with the burners in the second burner group.

According to another aspect of the present disclosure, the gas furnace may further include an inducer for causing a flow of combustion gas through the heat exchangers in the first heat exchanger group and the heat exchangers in the second heat exchanger group.

According to another aspect of the present disclosure, the heat exchangers in the first heat exchanger group and the heat exchangers in the second heat exchanger group may extend in the other direction crossing the one direction.

According to another aspect of the present disclosure, the blower may be positioned to be biased toward the second heat exchanger group with respect to a reference line extending in the other direction between the first heat exchanger group and the second heat exchanger group.

According to another aspect of the present disclosure, the three-way valve may further include a connector having a first part connected to the first tube, a second part connected to the second tube, and a third part connected to the third tube.

According to another aspect of the present disclosure, the three-way valve may further include a ball rotatably coupled to an inside of the connector, and having a first opening, a second opening, and a third opening facing in different directions.

According to another aspect of the present disclosure, a positional relationship between the second part and the third part with respect to the first part may be identical to a positional relationship between the second opening and the third opening with respect to the first opening.

According to another aspect of the present disclosure, the ball may be rotatable between a first position and a second position.

According to another aspect of the present disclosure, in response to the ball being located at the first position, the first opening may face the first part, the second opening may face the second part, and the third opening may face the third part.

According to another aspect of the present disclosure, in response to the ball being located at the second position, the second opening may face the first part, the first opening may face the third part, and the third opening may face an inner wall of the connector.

According to another aspect of the present disclosure, the three-way valve may further include: a rotary motor providing a rotational force; a shaft provided to be rotatable by power from the rotary motor, fixed to the ball through the connector, and providing a central axis of rotation of the ball; and a controller configured to control operation of the rotary motor.

According to another aspect of the present disclosure, a diameter of the ball may be greater than an inner diameter of the first part, an inner diameter of the second part, and an inner diameter of the third part.

According to another aspect of the present disclosure, the connector further may further include a groove positioned between the second part and the third part and corresponding to a surface of the ball.

According to another aspect of the present disclosure, the ball may further include a curved portion facing the first opening with respect to the second opening and the third opening, and a part of the curved portion may be inserted into the second part in response to the ball being located at the second position.

According to another aspect of the present disclosure, there is provided an air conditioner having an outdoor unit and a ventilator that are connected to each other through a refrigerant pipe. The ventilator may include: an air supply fan for causing a flow of air along an air supply passage; an exhaust fan for causing a flow of air along an exhaust passage separated from the air supply passage; a plurality of coils located in the air supply passage and having refrigerant flowing therethrough; and a gas furnace positioned downstream of the plurality of coils in the air supply passage.

A gas furnace and an air conditioner having the same according to the present disclosure may have effects as below.

According to at least one of the embodiments of the present disclosure, it is possible to implement a high Top Down Ratio (TDR) by supplying fuel to some burners using a three-way valve. That is, it is possible to provide a gas furnace capable of providing a user with thermal comfort and reducing heating cost and energy.

According to at least one of the embodiments of the present disclosure, it is possible to control the intensity of thermal power by adjusting an opening degree of a fuel valve or by selecting burners to which fuel is supplied through a three-way valve. That is, it is possible to provide a gas furnace in which thermal power can be controlled in stages in a wide range.

According to at least one of the embodiments of the present disclosure, it is possible to control a passage of a three-way valve based on rotation of a ball of the three-way valve. That is, it is possible to provide a mechanism capable of supplying fuel to some burners using a minimum number of valves.

According to at least one of the embodiments of the present disclosure, it is possible to use a rotary motor of the three-way valve to control a rotating direction of a ball connected thereto. That is, various methods for controlling the aforementioned mechanism may be provided according to required thermal power.

According to at least one of the embodiments of the present disclosure, a passage blocked by a three-way valve may be closed due to a close contact structure of a ball of the three-way valve.

According to at least one of the embodiments of the present disclosure, it is possible to provide a structure capable of minimizing the number of igniters and flame detectors in a plurality of burners due to characteristics of flame propagation between the plurality of burners.

According to at least one of the embodiments of the present disclosure, a flame detector may be detachably mounted to a burner box. That is, when implementing a high TDR, the user may be able to select burners to which fuel can be supplied.

According to at least one of the embodiments of the present disclosure, a blower may be disposed to be biased toward one side of the plurality of heat exchangers. That is, when the high TDR is implemented, a rate of heat transfer with air flowing by the blower of some heat exchangers through which combustion gas flows may be improved.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

FIGS. 10A and 10B are tables for explaining a Top Down Ratio (TDR) of a gas furnace according to an embodiment of the present disclosure.

FIG. 11 is a view for explaining a case where fuel having passed through a first tube is guided to a second tube and a third tube;

FIG. 12 is a view for explaining a case where fuel having passed through the first tube is guided to the third tube, and FIG. 13 is a view for explaining a case where fuel having passed through the first tube is guided to the second tube.

DESCRIPTION OF EXEMPLARY EMBODIMENTS

Figure 1:
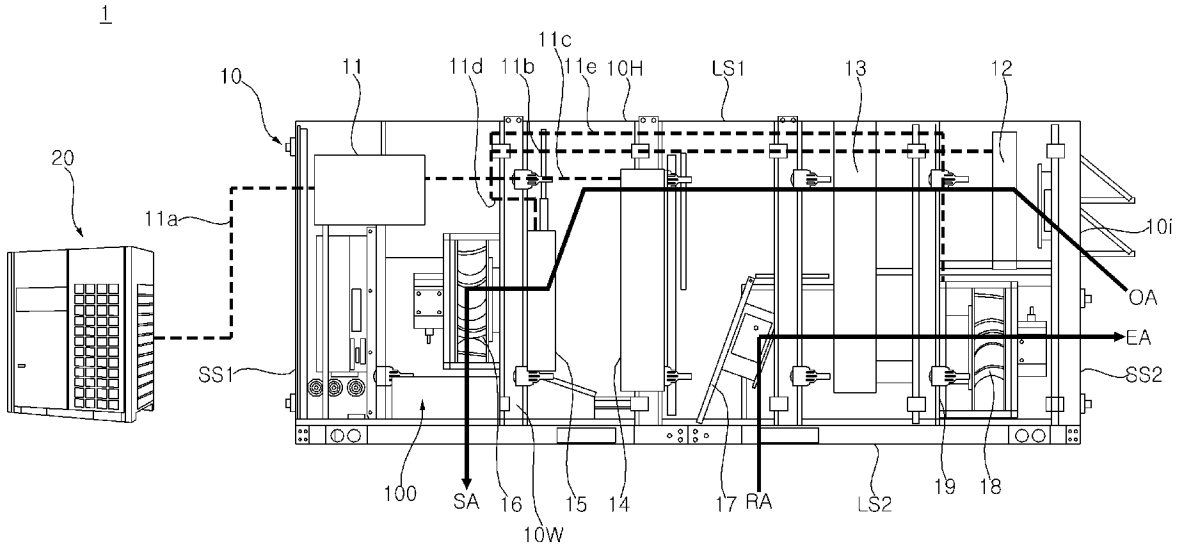
FIGS. 1 and 2 are views showing an internal configuration of an air conditioner according to an embodiment of the present disclosure.

Hereinafter, the embodiments disclosed in the present specification will be described in detail with reference to the accompanying drawings, but the same or similar components are assigned the same reference numerals regardless of reference numerals, and redundant description thereof will be omitted.

The suffixes "module" and "part" for components used in the following description are given or mixed in consideration of only the ease of writing the specification, and do not have distinct meanings or roles by themselves.

In addition, in describing the embodiments disclosed in the present specification, if it is determined that detailed descriptions of related known technologies may obscure the gist of the embodiments disclosed in this specification, the detailed description thereof will be omitted. In addition, the accompanying drawings are only for easy understanding of the embodiments disclosed in the present specification, and the technical spirit disclosed in the present specification is not limited by the accompanying drawings, and all changes included in the spirit and scope of the present disclosure, should be understood to include equivalents or substitutes.

Terms including ordinal numbers such as first, second, etc. may be used to describe various elements, but the elements are not limited by the terms. The above terms are used only for the purpose of distinguishing one component from another.

When a component is referred to as being "connected" or "connected" to another component, it may be directly connected or connected to the other component, but it is understood that other components may exist in between. On the other hand, when it is said that a certain component is "directly connected" or "directly connected" to another component, it should be understood that the other component does not exist in the middle.

A singular expression includes a plural expression unless the context clearly dictates otherwise.

In the following description, even if an embodiment is described with reference to specific figure, a reference numeral not indicated in the specific figure may be referred to if necessary, and the reference numeral not indicated in the specific figure may be used when indicated in the other figure.

Figure 2:
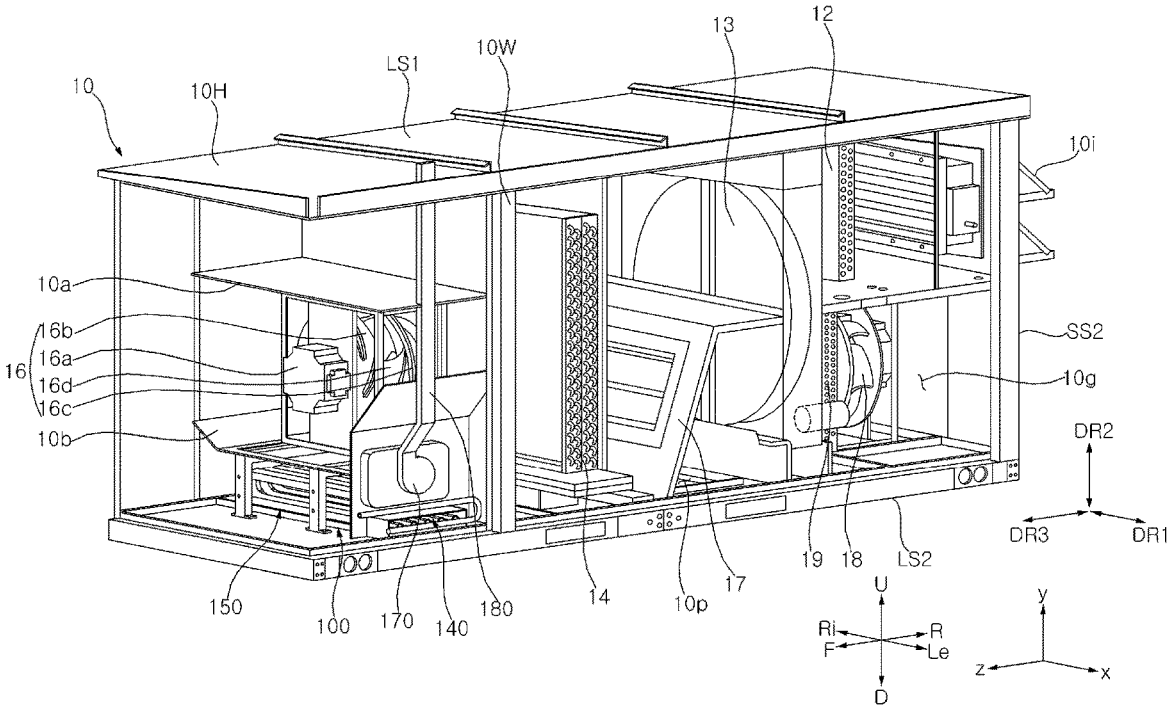

The directions of upward (U, y), downward (D), leftward (Le, x), rightward (Ri), forward (F, z), and rear direction (R) indicated in FIG. 2 are used for convenience of explanation, and the technical spirit of the present disclosure is not limited thereby.

Referring to FIGS. 1 and 2, an air conditioner 1 may include an outdoor unit 20 and a ventilator 10. The outdoor unit 20 may include a compressor (not shown) for compressing refrigerant and an outdoor heat exchanger (not shown) for performing heat exchange between refrigerant and outdoor air. The outdoor unit 20 may be connected to the ventilator 10 through a refrigerant pipe 11*a*. The refrigerant may circulate the outdoor unit 20 and the ventilator 10 through the refrigerant pipe. A housing 10H of the ventilator 10 may form the exterior of the ventilator 10.

The housing 10H may include a first long side LS1 and a second long side LS2 opposite to the first long side LS1. The first long side LS1 and the second long side LS2 may be collectively referred to as a long side LS1 and LS2. The housing 10H may include a first short side SS1 adjacent to the long side LS1 and LS2 and a second short side SS2 opposite the first short side SS1. The first short side SS1 and the second short side SS2 may be collectively referred to as a short side SS1 and SS2.

A direction vertically to the long side LS1 and LS2 and the short side SS1 and SS2 may be referred to as a first direction DR1 or a left-right direction. A direction parallel to the short side SS1 and SS2 may be referred to as a second direction DR2 or an up-down direction. A direction parallel to the long side LS1 and LS2 may be referred to as a third direction DR3 or a front-rear direction.

A side of the first long side LS1 may be referred to as an upper side (U, y), and a side of the second long side LS2 may be referred to as a lower side (D). A side of the first short side SS1 may be referred to as a front side (F, z), and a side of the second short side SS2 may be referred to as a rear side (R). In the first direction DR1, a direction toward one end of the short side SS1 and SS2 may be referred to as a left side (Le, x), and a direction toward the other end of the short side SS1 and SS2 may be referred to as a right side (Ri).

The ventilator 10 may include a refrigerant distributor 11, a plurality of heat exchangers 12, 13, 14, 15, and 19, a blower 16, a partition 17, and an exhaust fan 18. The refrigerant distributor 11, the plurality of heat exchangers 12, 13, 14, 15, and 19, the blower 16, the partition 17, and the exhaust fan 18 may be installed inside the housing 10H.

An air supply passage OA-SA may be formed between a first inlet 10*i* and a first outlet (not shown). The first inlet 10*i* may be formed to penetrate the second short side SS2 and may be adjacent to the first long side LS1. The first outlet may be formed to penetrate the second long side LS2 and may be adjacent to the first short side SS1. Outdoor air OA may be introduced into the first inlet 10*i*, and the first inlet 10*i* may be referred to as an outdoor air inlet. Supply air SA may be supplied into a room through the first outlet, and the first outlet may be referred to as a supply air outlet.

The blower 16 may be adjacent to the first outlet and located in the air supply passage OA-SA. The blower 16 may cause a flow of air along the air supply passage OA-SA. The blower 16 may be referred to as an air supply fan or a plug fan. Meanwhile, an air supply duct (not shown) may be connected to the second long side LS2 and may communicate with the first outlet and the indoor space. For example, the air volume per minute of the blower 16 may be 3,000 to 5,000 cubic feet per minute (CFM).

The exhaust passage RA-EA may be formed between the second inlet 10*p* and the second outlet 10*g*. The second inlet 10*p* may be formed to penetrate the second long side LS2 and may be spaced apart from the first outlet. The second outlet 10*g* may be formed through the second short side SS2 and may be adjacent to the second long side LS2. The bet (RA, room air, or return air) may be introduced into the second inlet 10*p*, and the second inlet 10*p* may be referred to as a bet inlet. Exhaust air (EA) may be discharged to the outside through the second outlet 10*g*, and the second outlet 10*g* may be referred to as an exhaust outlet.

The exhaust fan 18 may be located in the exhaust passage RA-EA adjacent to the second discharge port 10*g*. The exhaust fan 18 may cause a flow of air along the exhaust passage RA-EA. The exhaust fan 18 may be referred to as a blower or a plug fan. On the other hand, the inner duct (not shown) may be connected to the second long side (LS2), it may be in communication with the second inlet (10*p*) and the indoor space.

The partition wall 17 may divide the inner space of the housing 10H into a space in which the air supply passage OA-SA is formed and a space in which the exhaust passage RA-SA is formed. The partition wall 17 may be installed near the second inlet 10*p* of the housing 10H, and may include an inclined portion (unsigned) and a horizontal portion (unsigned). Accordingly, the air supply passage OA-SA may be located above the partition wall 17, and the exhaust passage RA-SA may be located below the partition wall 17.

The refrigerant distributor 11 may be adjacent to the first long side LS1 and the first short side SS1. One side of the refrigerant distributor 11 may be connected to the refrigerant pipe (11*a*). The other side of the refrigerant distributor 11 may be connected to a plurality of pipes 11*b*, 11*c*, 11*d*, and 11*e*. For example, the refrigerant distributor 11 may open and close the passage of each pipe through a solenoid valve. Here, each pipe 11*b*, 11*c*, 11*d*, or 11*e* may include a refrigerant pipe providing a passage of refrigerant supplied to each heat exchanger 12, 14, 15, or 19, and a refrigerant pipe providing a passage of refrigerant passing through each heat exchanger 12, 14, 15, or 19. In addition, each expansion valve (not shown) may expand the refrigerant flowing through each of the pipes 11*b*, 11*c*, 11*d*, and 11*e*. For example, the expansion valve may be an Electronic Expansion Valve (EEV) capable of adjusting the opening degree. In this case, when the expansion valve is fully opened, the expansion valve may not expand the refrigerant.

The preheater 12 may be located in the air supply passage OA-SA adjacent to the first inlet 10*i*. A preheater 12 may be disposed vertically within the housing 10H. A first pipe 11*b* may provide a refrigerant passage connecting the refrigerant distributor 11 and the preheater 12. Accordingly, the preheater 12 may heat air introduced into the first inlet 10*i*. The preheater 12 may be referred to as a preheat coil.

The heat exchanger 14 may be located downstream of the preheater 12 in the air supply passage OA-SA. The heat exchanger 14 may be vertically disposed within the housing 10H. A size of the heat exchanger 14 may be larger than a size of the preheater 12. The second pipe 11*c* may provide a refrigerant passage connecting the refrigerant distributor 11 and the heat exchanger 14. The heat exchanger 14 may be referred to as a main heat exchanger or a cooling/heating coil.

A reheater 15 may be located downstream of the heat exchanger 14 in the air supply passage OA-SA. The reheater 15 may be vertically disposed within the housing 10H. A size of the reheater 15 may be smaller than a size of the heat exchanger 14. The third pipe 11*d* may provide a refrigerant passage connecting the refrigerant distributor 11 and the reheater 15. The reheater 15 may be referred to as a reheat coil. Meanwhile, the reheater 15 may be operated based on a set indoor temperature and a set humidity. The reheater 15 may face the blower 16 with respect to a base 10W on which the reheater 15 is installed.

A recovery coil 19 may be located in an exhaust passage RA-EA adjacent to the exhaust fan 18. The recovery coil 19 may be vertically disposed within the housing 10H. A fourth pipe 11*e* may provide a refrigerant passage connecting the refrigerant distributor 11 and the recovery coil 19. Meanwhile, a heat transfer direction of the recovery coil 19 to air may be opposite to a heat transfer direction of the heat exchanger 14 to air.

A part of the recovery wheel 13 may be located in the air supply passage OA-SA between the preheater 12 and the heat exchanger 14, and the other part of the recovery wheel 13 may be located in the exhaust passage RA-EA between the recovery coil 19 and the inclined portion of the partition wall 17. The recovery wheel 13 may be referred to as an energy recovery wheel (ERW).

In this case, the recovery wheel 13 may have a flat cylinder shape as a whole. A honeycomb structure may be formed inside the recovery wheel 13, and air may pass through the honeycomb structure. The recovery wheel 13 may be rotated at a low speed. Accordingly, the recovery wheel 13 may recover sensible heat and latent heat by using temperature difference and humidity difference between the outdoor air OA and the indoor air RA.

Figure 3:
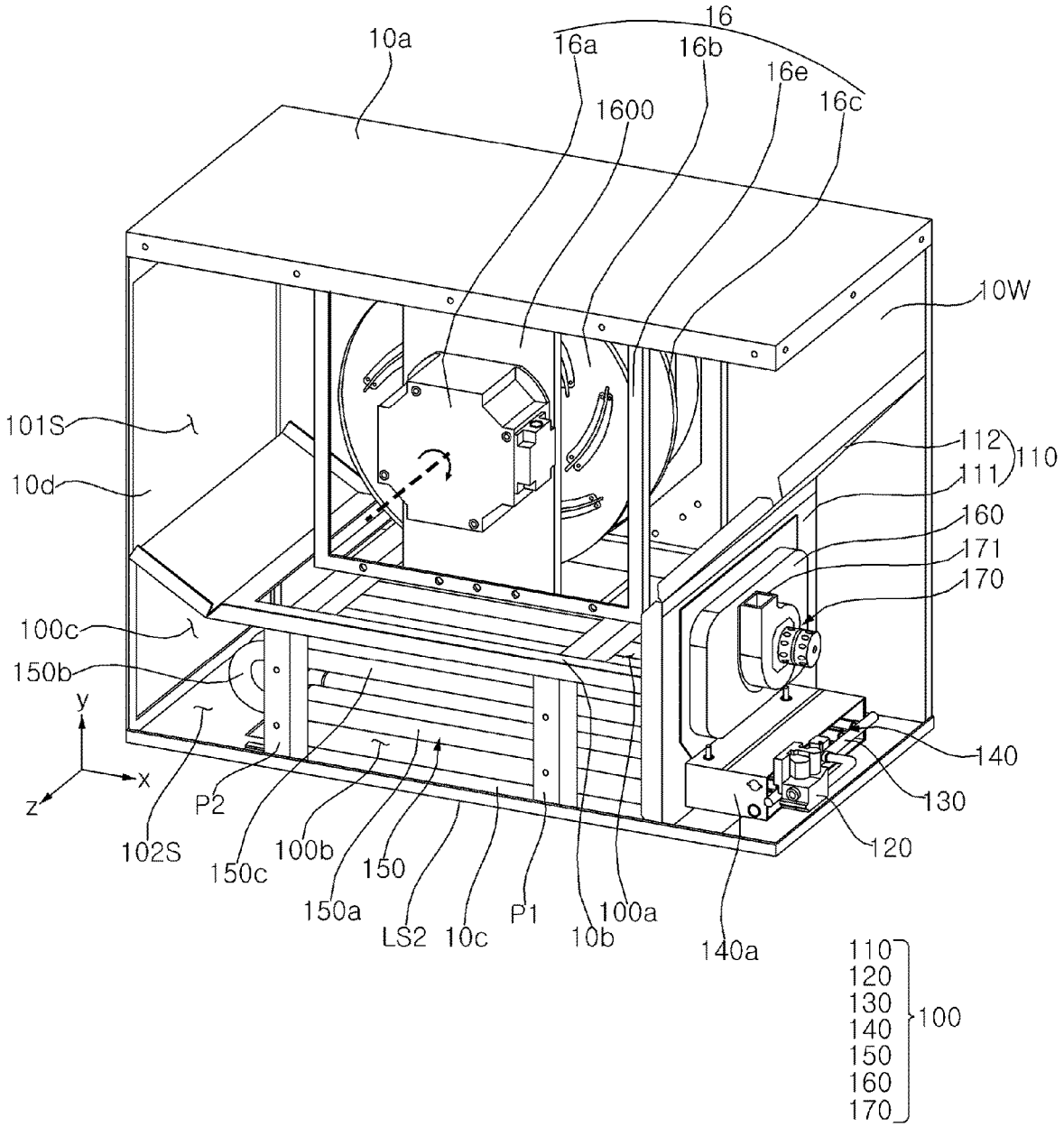
FIGS. 3 and 4 are views showing a gas furnace according to an embodiment of the present disclosure.

Referring to FIGS. 2 and 3, the blower 16 may include a motor 16*a*, a hub 16*b*, a shroud 16*c*, and a plurality of blades 16*d*. The hub 16*b*, the shroud 16*c*, and the plurality of blades 16*d* may be collectively referred to as an impeller 16*a*, 16*b*, and 16*c*.

The motor 16*a* may provide a rotational force. The motor 16*a* may be a centrifugal fan motor. The motor 16*a* may form a front end of the blower 16, and a rotational shaft of the motor 16*a* may extend rearward from the motor 16*a*. A longitudinal direction of the rotational shaft of the motor 16*a* may be referred to as an axial direction of the blower 16.

The hub 16*b* may be located at the rear of the motor 16*a* and may be fixed to the rotational shaft of the motor 16*a*. The hub 16*b* may have a disk shape.

The shroud 16*c* may be located at the rear of the hub 16*b* and may have a ring plate shape. The shroud 16*c* may be rotatably coupled to the base 10W. For example, an inlet (unsigned) may be fixed to a front surface of the base 10W between the shroud 16*c* and the base 10W, and may have a hyperbolic cylinder or funnel shape. In this case, the shroud 16*c* may be rotatably coupled to the inlet. A hole formed inside the shroud 16*c*, an inner space of the inlet, and a hole (not shown) formed in the base 10W may communicate with one another and be located in the air supply passage OA-SA (see FIG. 1).

The plurality of blades 16*d* may be located between an inner periphery and an outer periphery of the ring-shaped shroud 16*c*. The plurality of blades 16*d* may be coupled to the hub 16*b* and the shroud 16*c* between the hub 16*b* and the shroud 16*c*. The plurality of blades 16*d* may be formed integrally with the shroud 16*c* and the hub 16*b*.

In addition, the plurality of blades 16*d* may be spaced apart from each other in a rotating direction of the rotational shaft of the motor 16*a*. Each of the plurality of blades 16*d* may be convexly curved in the rotating direction of the rotational shaft (see FIGS. 4 and 5). Among the plurality of blades 16*d*, a blade positioned close to a mount plate 110 to be described later may be convex toward the mount plate 110.

Accordingly, when the impeller 16*a*, 16*b*, and 16*c* is rotated in a clockwise direction in response to driving of the motor 16*a*, air may be introduced in an axial direction of the blower 16 through a hole of the base 10W and may be pressed by the plurality of blades 16*d* to be discharged in a radial direction of the blower 16. In this case, a flow of air discharged by the blower 16 may be concentrated on the left side of the blower 16 rather than the right side of the blower 16.

A horizontal plate 10*a* may be vertically disposed on a front surface of the base 10W, and may be coupled to the front surface of the base 10W. The horizontal plate 10*a* may be located above the blower 16. The horizontal plate 10*a* may be referred to as a first horizontal wall or a first panel. Meanwhile, a frame 16*e* may form a skeleton of the blower 16, and a motor mount 1600 on which the motor 16*a* is mounted may be coupled to the frame 16*a*. The frame 16*e* may be coupled to the bottom of the horizontal plate 10*a*.

A top plate 10*b* may be disposed vertically to the front surface of the base 10W, and may be coupled to the front surface of the base 10W. The top plate 10*b* may be located below of the blower 16. The top plate 10*b* may be referred to as a second horizontal wall or a second panel. A top hole 100*a* may be formed to penetrate the top plate 10*b* in the up-down direction. The top hole 100*a* may be formed to be long in the left-right direction. In the up-down direction, at least a portion of the top hole 100*a* may overlap the blower 16.

A bottom plate 10*c* may be disposed vertically to the front surface of the base W, and may be coupled to the front surface of the base 10W. The bottom plate 10*c* may face the horizontal plate 10*a* with respect to the top plate 10*b*. The bottom plate 10*c* may form a part of the second long side LS2 of the housing 10H. The bottom hole 100*b* may be formed to penetrate the bottom plate 10*c* in the up-down direction. The bottom hole 100*b* may be formed to be long in the left-right direction. In the up-down direction, the bottom hole 100*b* may face the top hole 100*a*.

The side plate 10*d* may be disposed vertically to the front surface of the base W, and may be coupled to the front surface of the base W. The side plate 10*d* may be coupled to a right side of the horizontal plate 10*a*, a right side of the top plate 10*b*, and a right side of the bottom plate 10*c*. A side hole 100*c* may be formed to penetrate the side plate 10*d* in the left-right direction. The side hole 100*c* may be formed to be long in the front-rear direction. The side hole 100*c* may be located between a right side of the top plate 10*b* and a right side of the bottom plate 10*c*.

The mount plate 110 may include a first plate 111 and a second plate 112. The first plate 111 may be vertically disposed on the front surface of the base W and an upper surface of the bottom plate 10*c*, and may be coupled to the front surface of the base W and the upper surface of the bottom plate 10*c*. The first plate 111 may be coupled to a left side of the top plate 10*b*. The second plate 112 may extend obliquely in a direction away from the blower 16 from an upper end of the first plate 111. In this case, a left side of the base 10W, a left side of the horizontal plate 10*a*, a left side of the second plate 112, and a left side of the bottom plate 10*c* may be connected to a left side of the housing 10H.

A first space 101S may be formed between the horizontal plate 10*a* and the top plate 10*b*. A vertical plate (not shown) may be connected to a front end of the horizontal plate 10*a* and a front end of the top plate 10*b*, and may close a front side of the first space 101S. The first space 101S may communicate with the top hole 100*a*.

A second space 102S may be formed between the top plate 10*b* and the bottom plate 10*c*. The vertical plate may be connected to a front end of the top plate 10*b* and a front end of the bottom plate 10*c*, and may close the front side of the second space 102S. The second space 102S may communicate with the bottom hole 100*b* and the side hole 100*c*.

For example, the bottom hole 100*b* may be opened, and the side hole 100*c* may be closed. The side hole 100*c* may be closed by a detachable cover (not shown) or may not be initially formed in the side plate 10*d*.

As another example, the bottom hole 100*b* may be closed, and the side hole 100*c* may be opened. The bottom hole 100*b* may be closed by a detachable cover (not shown) or may not be initially formed in the bottom plate 10*c*.

Figure 4:
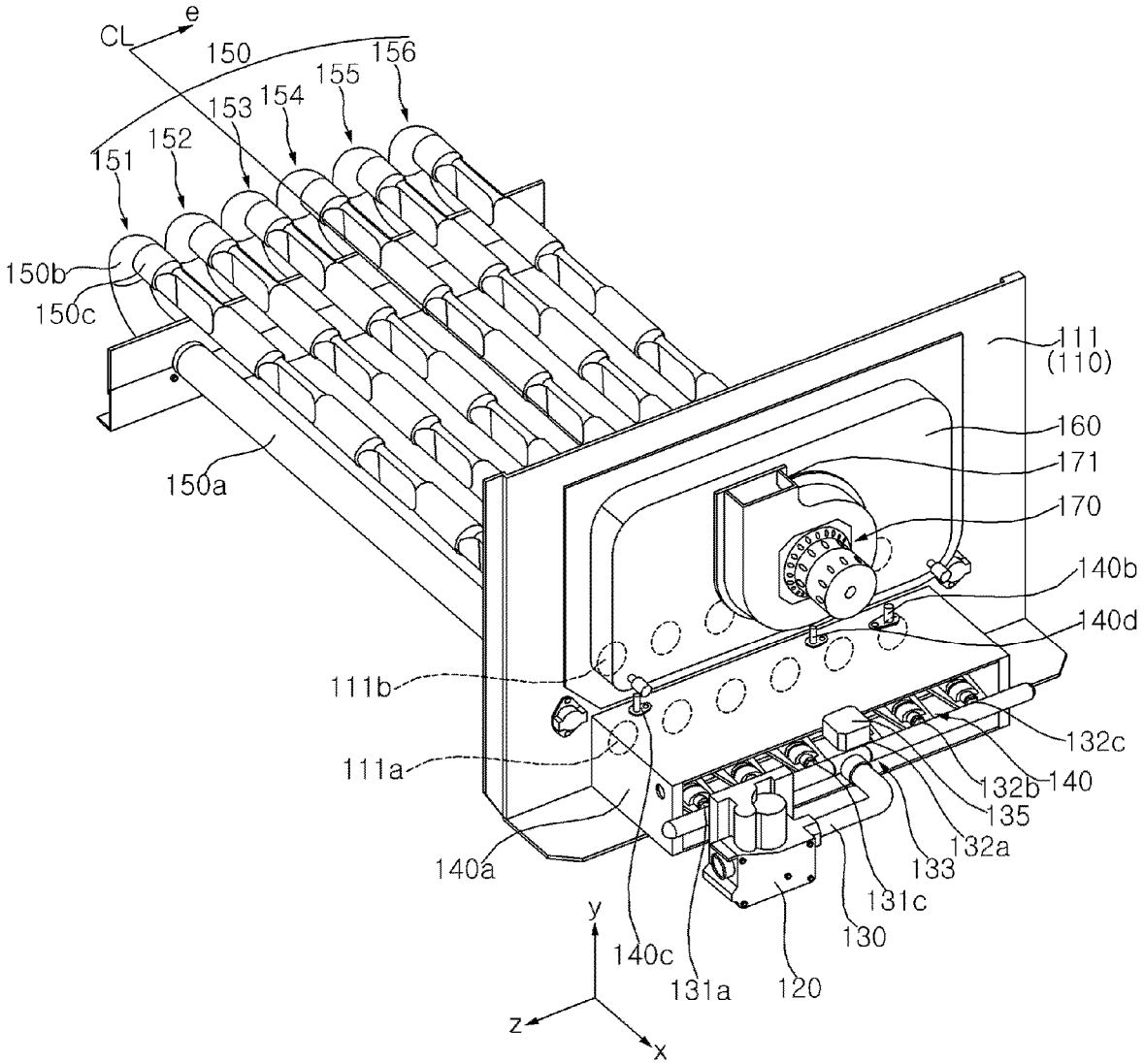

Referring to FIGS. 3 and 4, the gas furnace 100 may include a fuel valve 120, a manifold 130, a burner 140, a heat exchanger 150, a collect box 160, and an inducer 170.

The fuel valve 120 may supply fuel from a fuel source (not shown) connected to the fuel valve 120 to the manifold 130, or may block the supply of the fuel to the manifold 130. For example, the fuel may be Liquefied Natural Gas (LNG) or Liquefied Petroleum Gas (LPG). Meanwhile, by adjusting an opening degree of the fuel valve 120, it is possible to adjust an amount of the fuel supplied to the manifold 130. In other words, thermal power of the gas furnace 100 may be adjusted in stages using the fuel valve 120. The fuel valve 120 may be referred to as a modulating valve.

The burner 140 may be supplied with the fuel from the manifold 130. The burner 140 may burn the fuel. When the fuel is burned, a flame and high-temperature combustion gas may be generated. For example, the burner 140 may be provided in plural. A plurality of burners 140 may be installed inside a burner box 140*a*. The burner box 140*a* may be installed on the left of the first plate 111 of the mount plate 110.

The heat exchanger 150 may be located in the second space 102S between the top plate 10*b* and the bottom plate 10*c*. The heat exchanger 150 may provide a passage for the combustion gas. One end of the heat exchanger 150 may be coupled to the right of the first plate 111 of the mount plate 110. The other end of the heat exchanger 150 may be spaced apart from the one end of the heat exchanger 150, and may be coupled to the right of the first plate 111.

In addition, the heat exchanger 150 may be provided in plural. The number of heat exchangers 150 may be equal to the number of burners 140. A plurality of heat exchangers 151, 152, 153, 154, 155, and 156 may be connected to the plurality of burners 140, respectively. The plurality of heat exchangers 151, 152, 153, 154, 155, and 156 may be spaced apart from each other in the front-rear direction.

In addition, the heat exchanger 150 may be a tubular type heat exchanger. The heat exchanger 150 may include a first tube 150*a*, a bend 150*b*, and a second tube 150*c*. The passage of the combustion gas may be formed inside the first tube 150*a*, inside the bend 150*b*, and inside the second tube 150*c*. For example, a diameter of the first tube 150*a* may be substantially equal to a diameter of the bend 150*b* and a diameter of the second tube 150*c*.

The first tube 150*a* may extend long in the left-right direction. The left end of the first tube 150*a* may form the one end of the heat exchanger 150, and may be referred to as an inlet of the heat exchanger 150. The inlet of the heat exchanger 150 may communicate with the burner 140 through the first hole 111*a*. Here, the first hole 111*a* may be formed to pass through the first plate 111 in the left-right direction, and may be located between the inlet of the heat exchanger 150 and the burner 140. For example, the inlet of the heat exchanger 150 may be spaced apart from the burner 140. That is, air may be introduced into the burner 140 between the entry of the heat exchanger 150 and the burner 140, and the corresponding air may be referred to as secondary air.

The second tube 150*c* may extend long in the left-right direction. The second tube 150*c* may be spaced upward from the first tube 150*a*. A left end of the second tube 150*c* may form the other end of the heat exchanger 150, and may be referred to as an exit of the heat exchanger 150. The exit of the heat exchanger may communicate with the inside of the collect box 160 to be described later through a second hole 111*b*. In this case, the second hole 111*b* may be formed to penetrate the first plate 111 in the left-right direction, and may be located between the exit of the heat exchanger 150 and the collect box 160.

The bend 150*b* may be connected to a right end of the first tube 150*a* and a right end of the second tube 150*c*. The bend 150*b* may be convex to the right. The bend 150*b* may transfer the combustion gas passing through the first tube 150*a* to the second tube 150*c*. Accordingly, the combustion gas may flow to the right in the first tube 150*a*, and may flow to the left in the second tube 150*b*. The bend 150*b* may be referred to as a U-shaped bend.

Meanwhile, according to an embodiment, a bend connected to the left end of the second tube 150*c* and convex to the left, and a tube connected to the bend and disposed in parallel with the second tube 150*c* may be added.

The collect box 160 may be located above the burner box 140*a* and may be installed on the left of the first plate 111 of the mount plate 110. The combustion gas passing through the heat exchanger 150 may be introduced into the inside of the collect box 160.

The inducer 170 may be installed on the left of the collect box 160. The inlet of the inducer 170 may communicate with the inside of the collect box 160. An exit 171 of the inducer 170 may be connected to an exhaust pipe 180 (see FIG. 2). The inducer 170 may cause the combustion gas to flow through the heat exchanger 150, the collector box 160, the inducer 170, and the exhaust pipe 180. In addition, the inducer 170 may cause a fluid to flow through the burner 140. The inducer 170 may be referred to as a fan, a blower, or an induced draft motor (IDM).

The exhaust pipe 180 (see FIG. 2) may extend upward from the exit 171 of the inducer 170. The exhaust pipe 180 may pass through the second plate 112, the horizontal plate 10*a*, and the first long side LS1 of the mount plate 110, and may discharge the combustion gas to the outside. The combustion gas flowing through the exhaust pipe 180 may be referred to as exhaust gas.

Accordingly, the air discharged from the blower 16 may pass around the heat exchanger 150 through the top hole 100*a*, and may be supplied into an indoor space through the bottom hole 100*b* or the side hole 100*c*. In this case, the air passing around the heat exchanger 150 may receive thermal energy from the combustion gas flowing along the heat exchanger 150. That is, the temperature of the air may be increased while the air passes around the heat exchanger 150.

Meanwhile, the gas furnace 100 may include a roll-out switch, a limit switch, a pressure switch, and the like.

Figure 5:
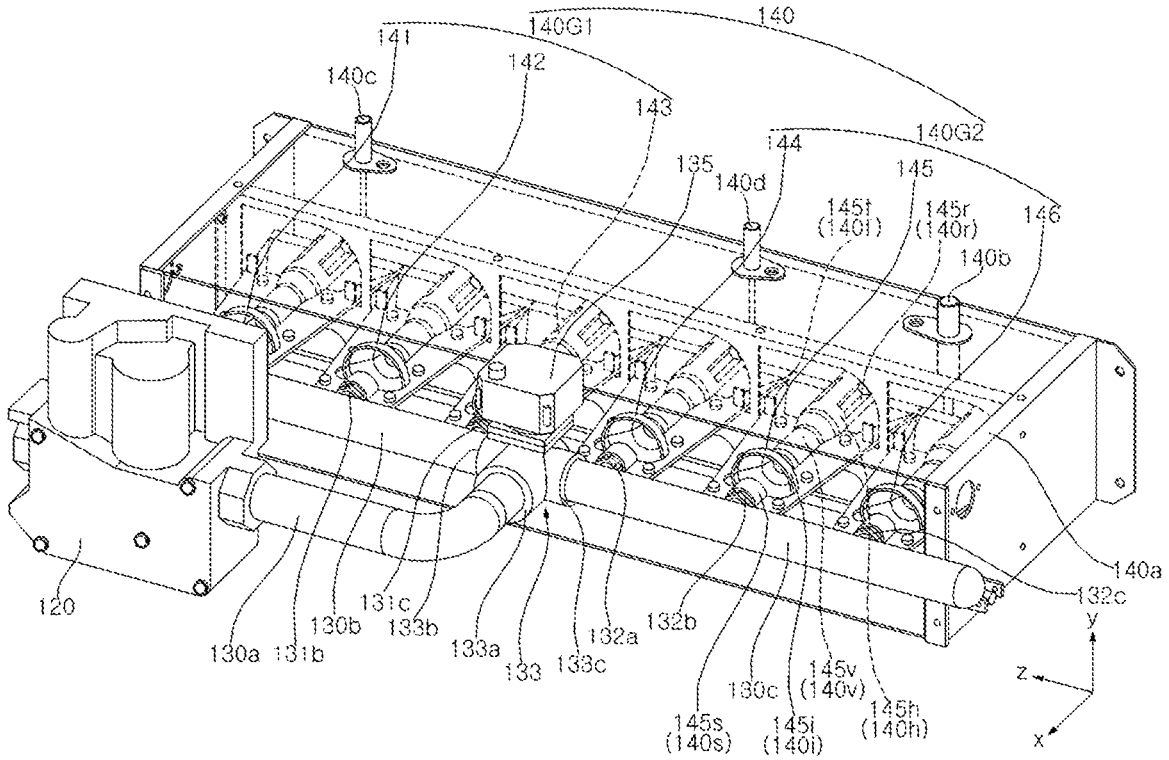
FIG. 5 is a view showing an internal configuration of a gas furnace according to an embodiment of the present disclosure.

Referring to FIGS. 4 and 5, a plurality of burners 141, 142, 143, 144, 145, and 146 may have the same shape. The plurality of burners 141, 142, 143, 144, 145, and 146 may be spaced apart from each other in the front-rear direction.

Each of the plurality of burners 141, 142, 143, 144, 145, and 146 may include a venturi portion 140*v* and a head portion 140*h*. The holder 140*s* may be connected to an entry 140*i* of the venturi portion 140*v*, and may face and be spaced apart from the entry 140*i* of the venturi portion 140*v*. The holder 140*s* may be referred to as a spud. For example, ribs 140*r* may be formed by being recessed inward of the head portion 140*h* from a side surface of the head portion 140*h*. For example, a retainer (not shown) may be inserted into the head portion 140*h* and seated on the ribs 140*r*, and a flame to be described above and below may be seated on the retainer.

Meanwhile, a flange 140*f* may be connected to the plurality of burners 141, 142, 143, 144, 145, 146 between the plurality of burners 141, 142, 143, 144, 145, 146. In this case, a flame propagation port may be formed in the flange 140*f* between the plurality of burners 141, 142, 143, 144, 145 and 146, and may provide a channel for flame propagation to be described later.

The plurality of burners 141, 142, 143, 144, 145, and 146 may be classified into two groups. A first burner 141, a second burner 142, a third burner 143, a fourth burner 144, a fifth burner 145, and a sixth burner 146 may be sequentially arranged in the front-rear direction. In this case, the first burner 141, the second burner 142, and the third burner 143 may be classified as a first burner group 140G1, and the fourth burner 144, the fifth burner 145, and the sixth burner 146 may be classified as a second burner group 140G2.

A connector 133 may be positioned between the first burner group 140G1 and the second burner group 140G2. The connector 133 may include a first part 133*a*, a second part 133*b*, and a third part 133*c*. The connector 133 may be referred to as a housing or a tube fitting.

The first part 133*a* may form a first end of the connector 133, and the first end may be a left end of the connector 133. The second part 133*b* may form a second end of the connector 133, and the second end may be a front end of the connector 133. The third part 133*c* may form a third end of the connector 133, and the third end may be a right end of the connector 133. The first part 133*a*, the second part 133*b*, and the third part 133*c* may communicate with each other.

The manifold 130 may include a first tube 130*a*, a second tube 130*b*, and a third tube 130*c*. The first tube 130*a*, the second tube 130*b*, and the third tube 130*c* may be connected to each other through the connector 133. The connector 133 may be positioned between the second tube 130*b* and the third tube 130*c*. For example, the first tube 130*a* may be bent at least once, and the second tube 130*b* and the third tube 130*c* may extend in the front-rear direction.

The first tube 130*a* may have one end of the first tube 130*a* connected to the fuel valve 120 and the other end connected to the first part 133*a*, and may form a first passage through which fuel may flow. The second tube 130*b* may have one end of the second tube 130*b* connected to the second part 133*b* and the other end of the second tube 130*b* blocked, and may form a second passage through which fuel may flow. The second tube 130*b* may extend in the front-rear direction, which is a direction in which the burners 141, 142, and 143 in the first burner group 140G1 are arranged, and may face the burners 141, 142, and 143 in the first burner group 140G1. The third tube 130*c* may have one end connected to the third part 133*c* and the other end blocked, and may form a third passage through which fuel may flow. The third tube 130*c* may extend in the front-rear direction, which is a direction in which the burners 144, 145, and 146 in the second burner group 140G2 are arranged, and may face the burners 144, 145, and 146 in the second burner group 140G2. That is, the third tube 130*c* may face the second tube 130*b* with respect to the connector 133.

A plurality of first nozzles 131*a*, 131*b*, and 131*c* may be coupled to the second tube 130*b*, and may be inserted into and fixed to respective holders 130*s* of the burners 141, 142, and 143 in the first burner group 140G1. A plurality of second nozzles 132*a*, 132*b*, and 132*c* may be coupled to the third tube 130*c*, and may be inserted into and fixed to respective holders 140S of the burners 144, 145, and 146 in the second burner group 140G2.

Accordingly, fuel provided from the fuel valve 120 to the first tube 130*a* may be provided to the second tube 130*b* and the third tube 130*c* through the connector 133.

In addition, the plurality of first nozzles 131*a*, 131*b* and 131*c* may inject the fuel of the second tube 130*b* to the burners 141, 142, and 143 in the first burner group 140G1. In this case, between the plurality of first nozzles 131*a*, 131*b*, and 131*c* and the burners 141, 142, and 143 in the first burner group 140G1, primary air may be entrained into the burners 141, 142, and 143 due to the inertial force and viscous force of the injected fuel.

In addition, the plurality of second nozzles 132*a*, 132*b*, and 132*c* may inject the fuel of the third tube 130*c* to the burners 144, 145, and 146 in the second burner group 140G2. In this case, between the plurality of second nozzles 132*a*, 132*b*, and 132*c* and the burners 144, 145, and 146 in the second burner group 140G2, primary air is entrained into the burners 144, 145, and 146 due to the inertial force and viscous force of the injected fuel.

That is, the primary air and the fuel may pass through the plurality of burners 141, 142, 143, 144, 145 and 146 to form a mixture, and the mixture may be burned together with the secondary air. Aflame formed through such combustion may be referred to as a partially premixed flame.

Meanwhile, an igniter 140*b* may be detachably mounted to the burner box 140*a* and may be adjacent to an exit of a burner positioned at one end of the plurality of burners 140. The igniter 140*b* may be adjacent to an exit of a burner positioned farthest from the first burner group 140G1 among the burners 144, 145, and 146 in the second burner group 140G2. That is, the igniter 140*b* may be adjacent to an exit of the sixth burner 146 and may burn fuel that has passed through the sixth burner 146. The flame formed at the exit of the sixth burner 146 may be propagated to the exits of the remaining burners 145, 144, 143, 142 and 141 through the flame propagation port described above with reference to FIG. 5. The propagated flame may burn fuel that has passed through the remaining burners 145, 144, 143, 142 and 141.

Meanwhile, a flame detector 140*c* may be detachably mounted to the burner box 140*a*, and may be adjacent to an exit of a burner positioned at the other end of the plurality of burners 140. The flame detector 140*c* may be adjacent to an exit of a burner positioned farthest from the second burner group 140G2 among the burners 141, 142, and 143 in the first burner group 140G1. That is, the flame detector 140*c* may be adjacent to an exit 141*e* of the first burner 141 and may detect whether a flame is formed at the exit 141*e* of the first burner 141. When the flame detector 140*c* detects a flame of the first burner 141, it is considered that a flame is formed in the remaining burners 142, 143, 144, 145, and 146 as a result of combustion due to the characteristics of flame propagation described above.

Figure 6:
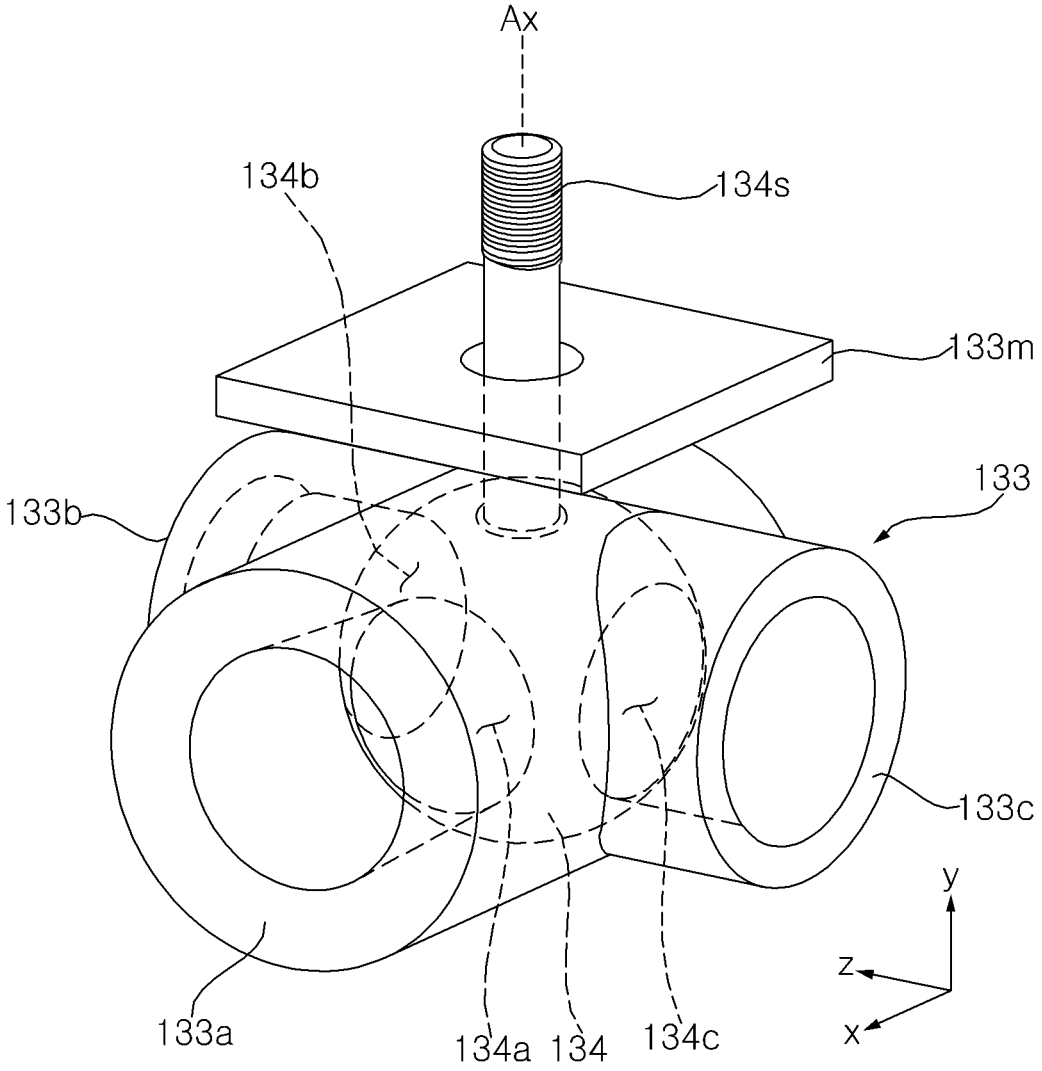
FIGS. 6 and 7 are views for explaining a three-way valve according to an embodiment of the present disclosure.
Figure 7:
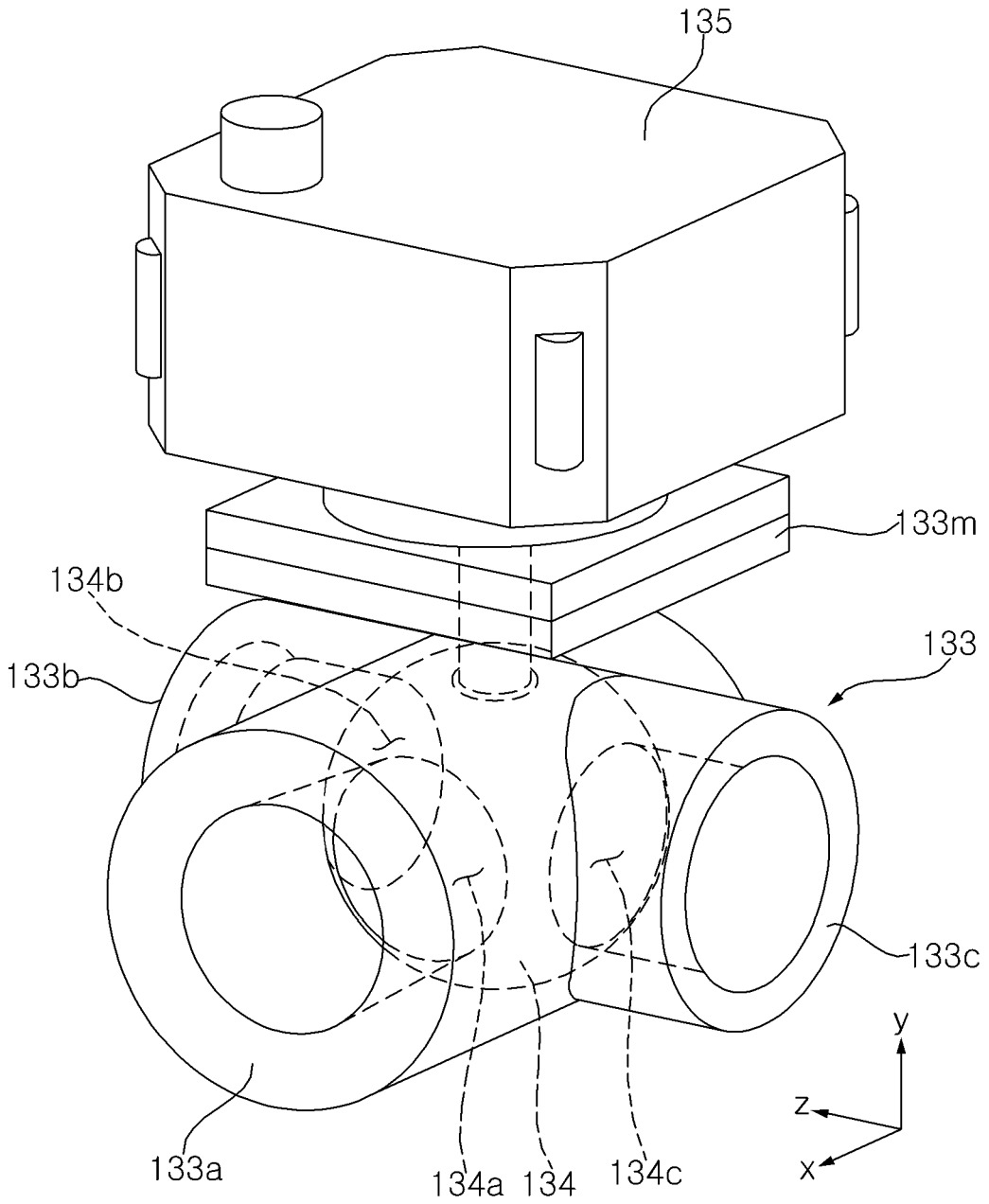

Referring to FIGS. 6 and 7, a ball 134 may be positioned between the first part 133*a*, the second part 133*b*, and the third part 133*c*, and may be rotatably coupled to the inside of the connector 133. The ball 134 may have a hollow sphere shape. The ball 134 may be opened in three directions. The inside of the ball 134 may communicate with the inside of the parts 133*a*, 133*b* and 133*c* of the connector 133 through openings 134*a*, 134*b* and 134*c* of the ball 134. A direction in which the ball 134 is opened may correspond to a direction in which each of the parts 133*a*, 133*b* and 133*c* extends from the connector 133. That is, the above-described positional relationship between the second part 133*b* and the third part 133*c* with respect to the first part 133*a* may be identical to a positional relationship between the second opening 134*b* and the third opening 134*c* with respect to the first opening 134*a*.

A shaft 134*s* may extend in the up-down direction. The shaft 134*s* may pass through the connector 133 and may be fixed to the ball 134. The shaft 134*s* may provide a central axis of rotation Ax of the ball 134. For example, the shaft 134*s* may be fixed to a rotational shaft of a rotary motor 135. For another example, the shaft 134*s* may be a rotational shaft of the rotary motor 135. The rotary motor 135 may be an electric motor capable of adjusting a direction of rotation and an angle of rotation.

A motor mount 133*m* may be coupled to an upper side of the connector 133, and the shaft 134*s* may pass therethrough. The rotary motor 135 may be mounted on the motor mount 133*m*.

Accordingly, when the rotary motor 135 is driven, the ball 134 may be rotated with respect to the central axis of rotation Ax.

The aforementioned connector 133, ball 134, the shaft 134*s*, and the rotary motor 135 may be collectively referred to as a three-way valve 133, 134, 134*s*, and 135. In addition, as described above and below, the three-way valve 133, 134, 134*s*, and 135 has an advantage of efficiently connecting or blocking a passage with a simple structure. However, the three-way valve applicable to the present disclosure is not limited thereto, and a generally used three-way valve may also be applied to the present disclosure.

Figure 8:
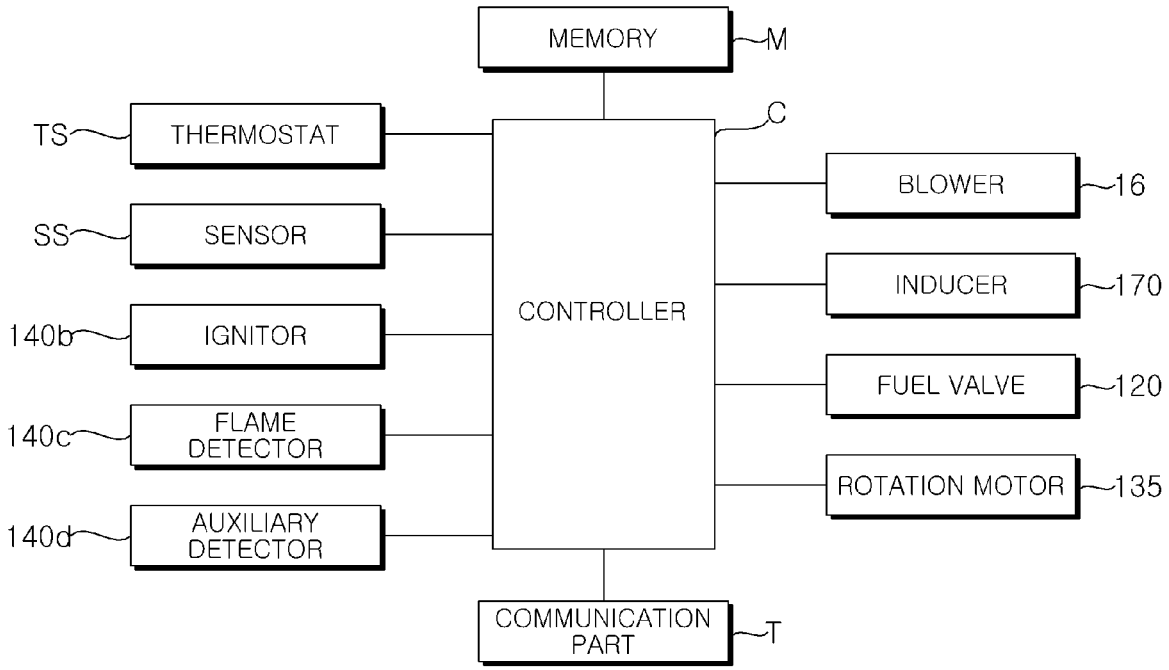
FIG. 8 is a diagram illustrating a control configuration of a gas furnace according to an embodiment of the present disclosure.

Referring to FIG. 8, a controller C of the gas furnace may receive information from a thermostat TS provided in an indoor space through a communication part T. For example, information received from the thermostat TS may include information such as a heating signal, heating intensity, a desired indoor temperature, or a current indoor temperature.

The controller C may receive information on operation of the gas furnace from a sensor SS. For example, the sensor SS may detect temperature of air introduced into or discharged from the blower 16, or may sense temperature of air that has passed through the heat exchanger 150.

The igniter 140*b* and the flame detector 140*c* may be electrically connected to the controller C. That is, the controller C may control operation of the igniter 140*b* and may receive information on whether or not a flame is detected from the flame detector 140*c*.

The blower 16, the inducer 170, and the fuel valve 120 may be electrically connected to the controller C. That is, the controller C may control a revolution per minute (RPM) of the blower 16, an RPM of the inducer 170, and an opening degree of the fuel valve 120.

The rotary motor 135 may be electrically connected to the controller C. That is, the controller C may control a direction of rotation and an angle of rotation of the rotary motor 135.

The memory M may be electrically connected to the controller C. The memory M may store information related to operation of the gas furnace, information related to a control operation of the controller C, and the like, and may provide the stored information to the controller C.

Figure 9:
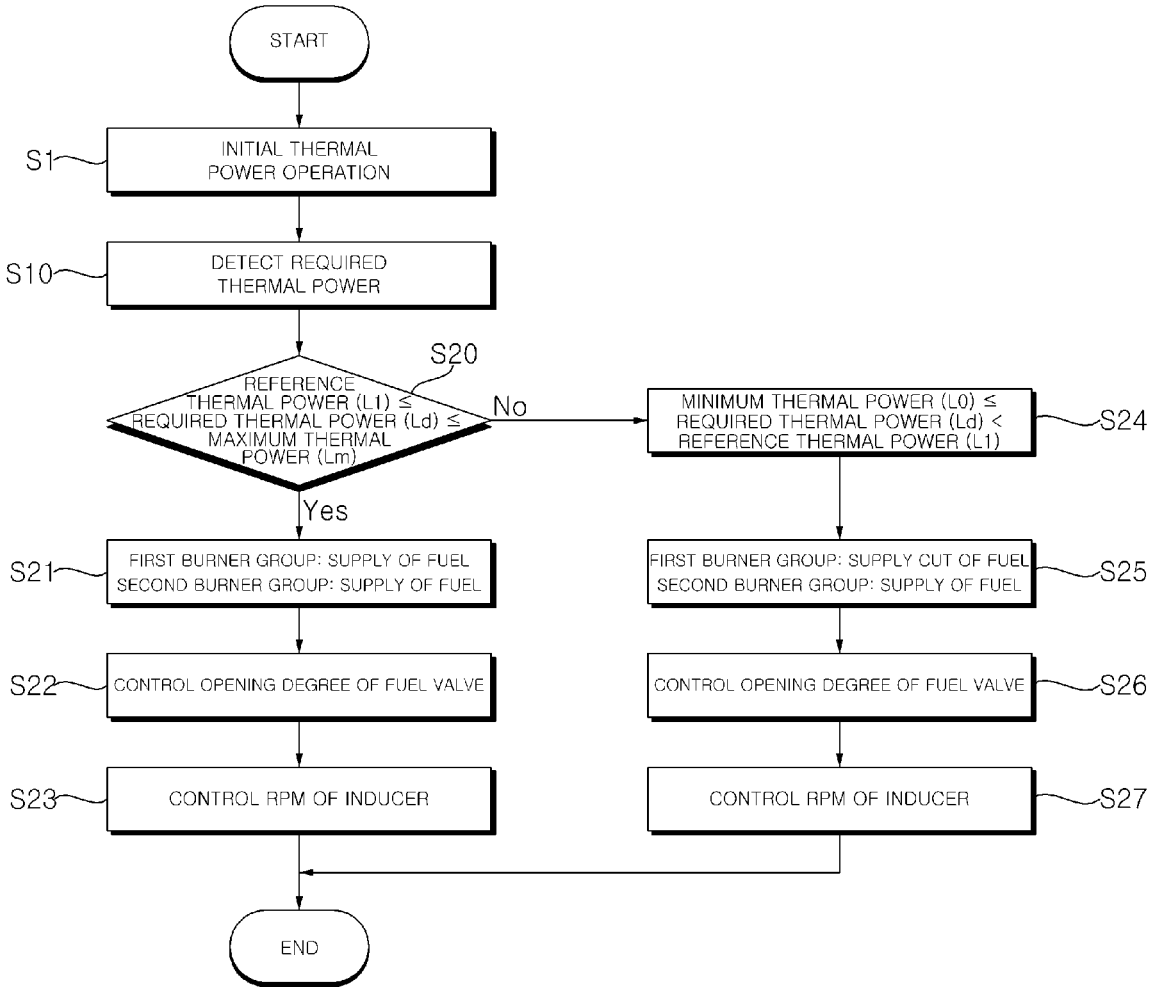
FIG. 9 is a flowchart illustrating a method for controlling a gas furnace according to an embodiment of the present disclosure.

Referring to FIGS. 8 and 9, the controller C may perform an initial thermal power operation in S1 That is, in consideration of an air ratio and stable ignition, an initial operation may be performed with an initial thermal power that corresponds to ¾ of a maximum thermal power.

After S1, the controller C may detect a required thermal power in S10. For example, a required thermal power Ld may be a thermal power that is arbitrarily input by a user through the thermostat TS. In another example, a required thermal power Ld may increase as a difference (hereinafter, referred to as temperature difference) between a desired indoor temperature input to the thermostat TS and a current indoor temperature sensed by a thermocouple of the thermostat TS is larger. In yet another example, a required thermal power Ld may be determined based on a temperature difference and temperature information of air flowing into the blower 16 sensed by the sensor SS.

After S10, the controller C may determine whether the required thermal power Ld is greater than or equal to a reference thermal power L1 and less than or equal to a maximum thermal power Lm (S20). For example, the reference thermal power L1 may be ¼ of the maximum thermal power Lm.

Referring to FIGS. 5 and 10, the maximum thermal power Lm of the gas furnace may be 100,000 Btu/h. When the number of burners 141, 142, 143, 144, 145, and 146 of the gas furnace is 6, a maximum thermal power per burner may be 16,667 Btu/h. In addition, considering flame stability of the burner, the minimum force per burner may be 4,167 Btu/h. That is, a maximum TDR per burner may be limited to 4 (=16,667/4,167). Here, the TDR refers to a ratio of maximum thermal power to minimum thermal power.

Referring to (a) of FIG. 10, a required thermal power Ld of the gas furnace may be 25,000 Btu/h. In this case, a TDR of the gas furnace may be 4 (=100,000/25,000). In order to implement the above required thermal power Ld, the first burner group 140G1 and the second burner group 140G2 may each have a thermal power of 12,500 Btu/h. In other words, each of the burners 141, 142, and 143 in the first burner group 140G1 may have a thermal power of 4,167 Btu/h, and each of the burners 144, 145, and 146 in the second burner group 140G2 may have a thermal power of 4,167 Btu/h.

Referring to (b) of FIG. 10, the required thermal power Ld of the gas furnace may be 12,500 Btu/h. In this case, the TDR of the gas furnace may be 8 (=100,000/12,500). In order to implement the above required thermal power Ld, the first burner group 140G1 may have no thermal power, but the second burner group 140G2 may have a thermal power of 12,500 Btu/h. In other words, each of the burners 144, 145, and 146 in the second burner group 140G2 may have a thermal power of 4,167 Btu/h.

Accordingly, although the maximum TDR per burner is limited to 4, it is possible to implement the maximum TDR of the gas furnace up to 8. In this case, the reference thermal power L1 may be determined to be ¼ of the maximum thermal power Lm, and the minimum thermal power L0 of the gas furnace may be ⅛ of the maximum thermal power Lm.

When the required thermal power Ld is greater than or equal to the reference thermal power L1 and less than or equal to the maximum thermal power Lm (Yes in S20), the controller C may perform a first operation mode S21, S22, and S23 which will be described later with reference to FIGS. 9 and 11 (see FIG. 9).

When the required thermal power Ld is less than the reference thermal power L1 (No in S20), the required thermal power Ld may fall within a range from the minimum thermal power L0 to the reference thermal power L1 (S24) and the controller C may perform a second operation mode S25, S26, and S27, which will be described later with reference to FIGS. 9 and 12 (see FIG. 9).

Figure 11:
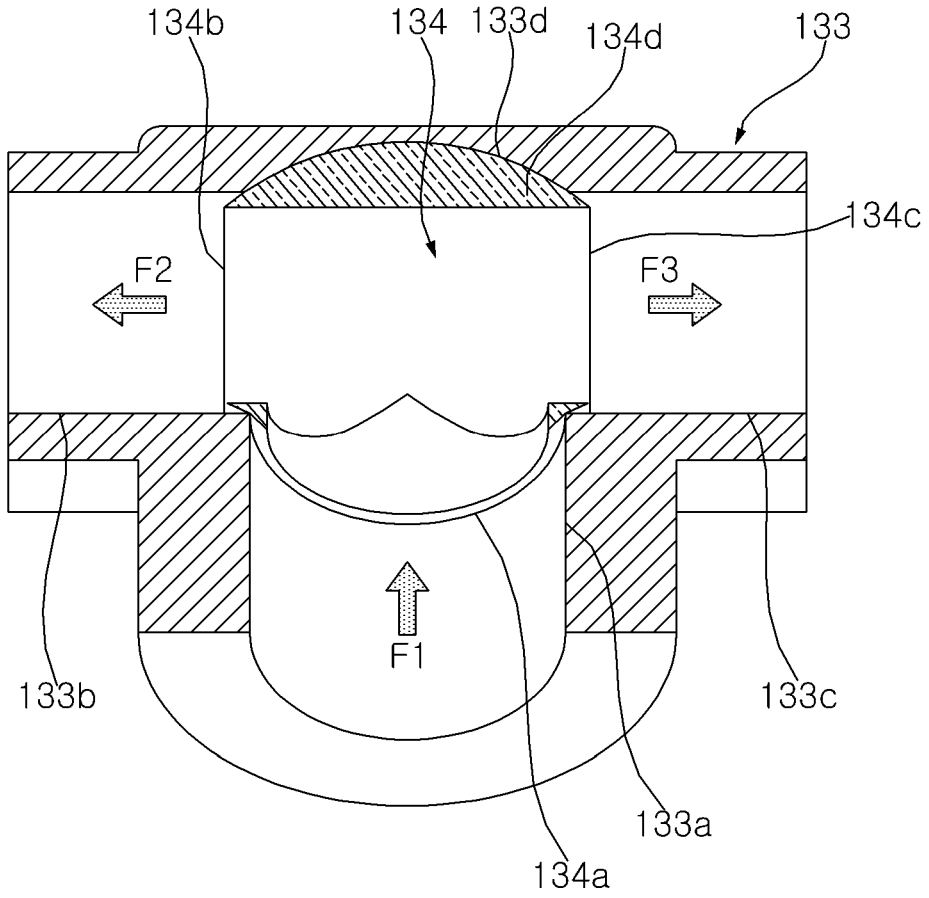
FIGS. 11 to 13 are views for explaining a passage of a three-way valve according to an embodiment of the present disclosure: specifically.

Referring to FIGS. 9 and 11, in the first operation mode S21, S22, and S23, the controller C (see FIG. 8) may control a direction of rotation and an angle of rotation of the rotary motor 135 so that the first part 133*a* communicates with the second part 133*b* and the third part 133*c*. In this case, some F2 of fuel F1 passing through the first tube 130*a* may be provided to the second tube 130*b* and the first burner group 140G1 through the ball 134, and the remaining F3 may be provided to the third tube 130*c* and the second burner group 140G2 through the ball 134 (S21).

Specifically, the first opening 134*a* of the ball 134 may face a passage of the first part 133*a*. The second opening 134*b* of the ball 134 may face a passage of the second part 133*b*. The third opening 134*c* of the ball 134 may face a passage of the third part 133*c*. In this case, the ball 134 may be located at a first position.

In response to the required thermal power Ld, the controller C may control an opening degree of the fuel valve 120 (see FIG. 4) and the RPM of the inducer 170 (see FIG. 4) (S22 and S23). That is, as the required thermal power Ld is smaller, the opening degree of the fuel valve 120 and the RPM of the inducer 170 may be reduced.

Accordingly, the gas furnace may implement the required thermal power Ld in a range between the reference thermal power L1 and the maximum thermal power Lm.

Figure 12:
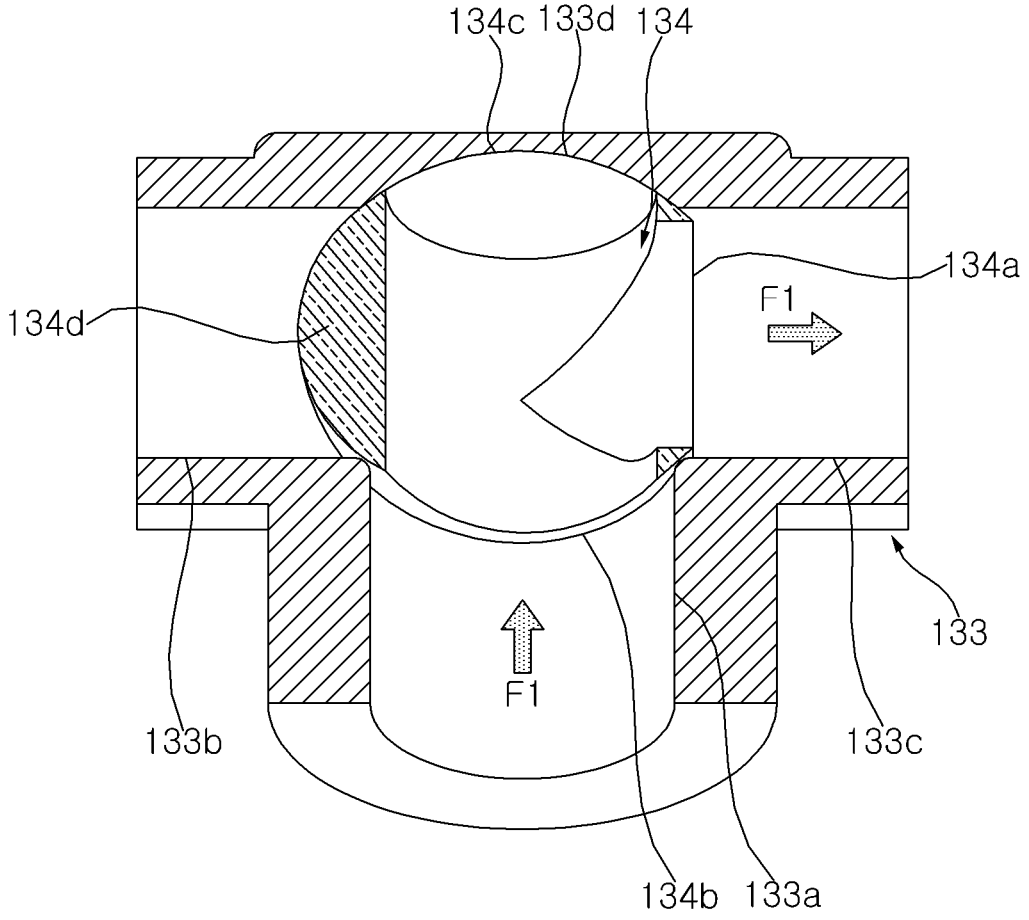

Referring to FIGS. 9 and 12, in the second operation mode S25, S26, and S27, the controller C (see FIG. 8) may control a direction of rotation and an angle of rotation of the rotary motor 135 so that the first part 133*a* communicates with the third part 133*c* while not communicating with the second part 133*b*. In this case, the fuel F1 passing through the first tube 130*a* may be provided to the third tube 130*c* and the second burner group 140G2 through the ball 134 (S25).

Specifically, the first opening 134*a* of the ball 134 may face the passage of the third part 133*c*. The second opening 134*b* of the ball 134 may face the passage of the first part 133*a*. The third opening 134*c* of the ball 134 may face an inner wall of the connector 133. The ball 134 may close the passage of the second part 133*b*. In this case, the ball 134 may be located at a second position.

In response to the required thermal power Ld, the controller C may control an opening degree of the fuel valve 120 (see FIG. 4) and the RPM of the inducer 170 (see FIG. 4) (S26 and S27). That is, as the required thermal power Ld is smaller, the opening degree of the fuel valve 120 and the RPM of the inducer 170 may be reduced.

Accordingly, the gas furnace may implement the required thermal power Ld in a range between the minimum force L0 and the reference thermal power L1.

Referring back to FIGS. 11 and 12, a diameter of the ball 134 may be greater than an inner diameter of the first part 133*a*, an inner diameter of the second part 133*b*, and an inner diameter of the third part 133*c*. In addition, a curved portion 134*d* of the ball 134 may face the first opening 134*a* with respect to the second opening 134*b* and the third opening 134*c*. Accordingly, when the ball 134 is located at the second position, a portion of the curved portion 134*d* may be inserted into the second part 133*b* and the passage of the second part 133*b* may be sealed.

A groove 133*d* may be formed in a portion of the connector 133 positioned between the second part 133*b* and the third part 133*c* and may have a shape corresponding to a surface of the ball 134. Accordingly, the groove 133*d* may contact the ball 134 rotating between the first position and the second position, and may support the rotation of the ball 134.

Referring back to FIGS. 5 and 12 again, the aforementioned igniter 140*b* may be adjacent to an exit of a burner located at one end of the second burner group 140G2. In this case, an auxiliary detector 140*d* may be detachably mounted to the burner box 140*a*, and may be adjacent to an exit of a burner located at the other end of the second burner group 140G2. The auxiliary detector 140*d* may be adjacent to an exit of a burner located closest to the first burner group 140G1 among the burners 144, 145, and 146 in the second burner group 140G2. That is, the igniter 140*b* may be adjacent to the exit of the sixth burner 146, and the auxiliary detector 140*d* may be adjacent to the exit of the fourth burner 144.

Accordingly, in the second operation mode S25, S26, and S27 described above with reference to FIGS. 9 and 12, a flame formed at the exit of the sixth burner 146 by the igniter 140*b* may be propagated to the exits of the remaining burners 145 and 144 in the second burner group 140G2. The propagated flame may burn the fuel that has passed through the remaining burners 145 and 144. In addition, the auxiliary detector 140*d* may detect whether a flame is formed at the exit of the fourth burner 144. When the auxiliary detector 140*d* detects the flame of the fourth burner 144, it may be considered that a flame is formed in the remaining burner 145 as a result of the combustion due to the characteristics of flame propagation described above.

The controller C (see FIG. 8) may be electrically connected to the auxiliary detector 140*d*, and may receive information as to whether or not a flame is detected from the auxiliary detector 140*d*.

Referring back to FIGS. 3 and 4, a first heat exchanger 151, a second heat exchanger 152, and a third heat exchanger 153 may be classified as a first heat exchanger group 151, 152, and 153, and a fourth heat exchanger 154, a fifth heat exchanger 155, and a sixth heat exchanger 156 may be classified as a second heat exchanger groups 154, 155, and 156.

The first heat exchanger group 151, 152, and 153 may communicate with the first burner group 140G1 (see FIG. 5), and the second heat exchanger group 154, 155, and 156 may communicate with the second burner group 140G2.

The reference line CL may extend between the first heat exchanger group 151, 152, and 153 and the second heat exchanger group 154, 155, and 156 in a longitudinal direction of the heat exchanger 150, that is, in the left-right direction. The reference line CL may be referred to as a central line of the heat exchanger.

In this case, the blower 16 may be positioned to be biased toward the second heat exchanger group 154, 155, and 156 with respect to the reference line CL (see FIG. 4E). That is, air flowing by the blower 16 may be concentrated toward the second heat exchanger group 154, 155, and 156 rather than the first heat exchanger group 151, 152, and 153.

Accordingly, in the second operation mode S25, S26, and S27 described above with reference to FIGS. 9 and 12, the air passing around the heat exchanger 150 by the blower 16 may easily receive thermal energy from high-temperature combustion gas passing through the second burner group 140G2 (see FIG. 5).

Figure 13:
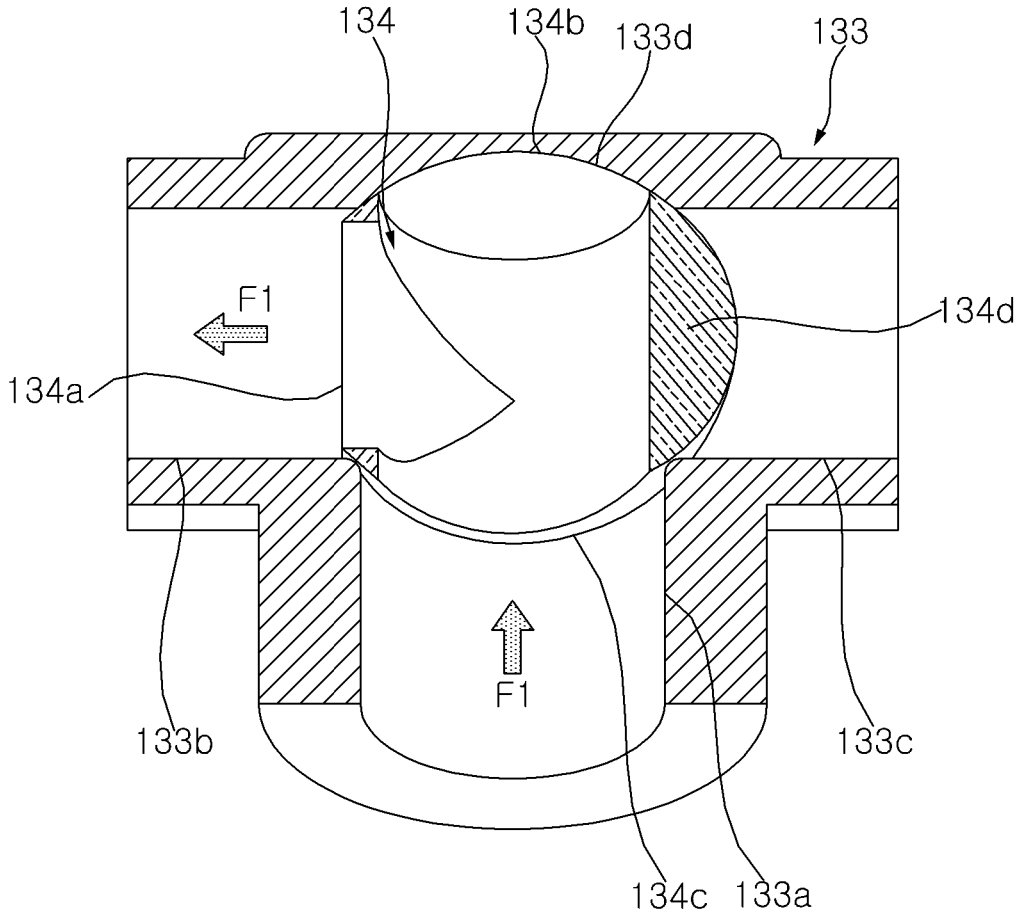

Referring to FIGS. 9 and 13, unlike the above description, the controller C (see FIG. 8) may control a direction of rotation and an angle of rotation of the rotary motor 135 so that the first part 133*a* and the second part 133*b* are allowed to communicate with each other while not communicating with the third part 133*c*, in S25. In this case, the fuel F1 passing through the first tube 130*a* may be provided to the second tube 133*b* and the first burner group 140G1 through the ball 134.

Specifically, the first opening 134*a* of the ball 134 may face the passage of the second part 133*b*. The second opening 134*b* of the ball 134 may face the groove 133*d*. The third opening 134*c* of the ball 134 may face the passage of the first part 133*a*. A part of the curved portion 134*d* of the ball 134 may be inserted into the third part 133*c*, and the ball 134 may close the passage of the third part 133*c*.

In this case, unlike the above description provided with reference to FIG. 5, the igniter 140*b* may be adjacent to the exit of the first burner 141, the flame detector 140*c* may be adjacent to the exit of the sixth burner 146, and the auxiliary detector 140*d* may be adjacent to the exit of the third burner 143.

That is, in S25, which group of the first burner group 140G1 and the second burner group 140G2 is to be supplied with fuel may be determined depending on the positions of the igniter 140*b*, the flame detector 140*c*, and the auxiliary detector 140*d*, an installation environment of the gas furnace, or a position of the blower 16 relative to the heat exchanger 150. Alternatively, if necessary, the first burner group 140G1 and the second burner group 140G2 may be alternately supplied with fuel in S25, and the positions of the igniter 140*b*, the flame detector 140*c*, and the auxiliary detector 140*d* may be changed together whenever the group to which is supplied is changed.

Certain embodiments or other embodiments of the disclosure described above are not mutually exclusive or distinct from each other. Any or all components of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure.

What is claimed is:

1. A gas furnace, comprising:

a fuel valve;

a manifold that provides a passage of fuel passing through the fuel valve;

a plurality of burners configured to burn fuel provided from the manifold and spaced apart from each other in a first direction;

a plurality of heat exchangers that provides a passage of combustion gas generated by the plurality of burners; and a blower configured to cause a flow of air passing around the heat exchanger, wherein the manifold comprises:

a first tube having one end connected to the fuel valve and that forms a first passage;

a second tube that extends in the first direction, forms a second passage, and faces at least one of the plurality of burners;

a third tube that extends in the first direction, forms a third passage, and faces remaining burners of the plurality of burners; and a three-way valve connected to the first tube, the second tube, and the third tube, wherein the three-way valve comprises:

a connector having a first part connected to the first tube, a second part connected to the second tube, and a third part connected to the third tube; and a ball rotatably coupled to an inside of the connector, and having a first opening, a second opening, and a third opening that faces in different directions, and wherein a positional relationship between the second part and the third part with respect to the first part is identical to a positional relationship between the second opening and the third opening with respect to the first opening.

2. The gas furnace of claim 1, wherein the three-way valve guides fuel passing through the first passage to flow to the second passage and the third passage or to the third passage.

3. The gas furnace of claim 2, wherein the plurality of burners comprises:

a first burner group with burners that face the second tube; and a second burners group with burners that face the third tube, and wherein the three-way valve is positioned between the second tube and the third tube.

4. The gas furnace of claim 3, wherein a number of the burners in the first burner group is equal to a number of the burners in the second burner group.

5. The gas furnace of claim 3, further comprising:

a plurality of first nozzles that is connected to the second tube, faces the burners in the first burner group, and is spaced apart from the burners in the first burner group; and a plurality of second nozzles that is connected to the third tube, faces the burners in the second burner group, and is spaced apart from the burners in the second burner group.

6. The gas furnace of claim 5, wherein each of the burners in the first burner group further comprises:

a venturi portion that forms an entry of a corresponding one of the burners in the first burner group;

a head portion that forms an exit of the corresponding one of the burners of the first burner group;

a retainer inserted into the head part; and a holder connected to the venturi portion and having a corresponding one of the plurality of first nozzles inserted thereinto and fixed thereto.

7. The gas furnace of claim 3, further comprising:

a flange connected to the plurality of burners between the plurality of burners and forming a flame propagation port;

a burner box that accommodates the plurality of burners and the flange;

an igniter mounted to the burner box and adjacent to an exit of a burner positioned farthest from the first burner group among the burners in the second burner group; and a flame detector mounted to the burner box and adjacent an exit of a burner positioned farthest from the second burner group among the burners in the first burner group.

8. The gas furnace of claim 3, wherein the plurality of heat exchangers comprises:

a first heat exchanger group with heat exchangers in communication with the burners in the first burner group; and a second heat exchanger group with heat exchangers in communication with the burners in the second burner group, and wherein the gas furnace further comprises an inducer that causes a flow of combustion gas through the heat exchangers in the first heat exchanger group and the heat exchangers in the second heat exchanger group.

9. The gas furnace of claim 8, wherein the heat exchangers in the first heat exchanger group and the heat exchangers in the second heat exchanger group extend in a second direction crossing the first direction, and wherein the blower is positioned to be biased toward the second heat exchanger group with respect to a reference line extending in the second direction between the first heat exchanger group and the second heat exchanger group.

10. The gas furnace of claim 1, wherein the ball is rotatable between a first position and a second position, wherein in response to the ball being located at the first position, the first opening faces the first part, the second opening faces the second part, and the third opening faces the third part, and wherein in response to the ball being located at the second position, the second opening faces the first part, the first opening faces the third part, and the third opening faces an inner wall of the connector.

11. The gas furnace of claim 10, wherein the three-way valve further comprises:

a rotary motor that provides a rotational force;

a shaft provided to be rotatable by power from the rotary motor, fixed to the ball through the connector, and that provides a central axis of rotation of the ball; and a controller configured to control an operation of the rotary motor.

12. The gas furnace of claim 10, wherein a diameter of the ball is greater than an inner diameter of the first part, an inner diameter of the second part, and an inner diameter of the third part, and wherein the connector further comprises a groove positioned between the second part and the third part and corresponding to a surface of the ball.

13. The gas furnace of claim 12, wherein the ball further comprises a curved portion that faces the first opening with respect to the second opening and the third opening, and wherein a part of the curved portion is inserted into the second part in response to the ball being located at the second position.

14. A gas furnace comprising:

a fuel valve;

a manifold that provides a passage of fuel passing through the fuel valve;

a plurality of burners configured to burn fuel provided from the manifold and spaced apart from each other in a first direction;

a plurality of heat exchangers that provides a passage of combustion gas generated by the plurality of burners; and a blower configured to cause a flow of air passing around the heat exchanger, wherein the manifold comprises:

a first tube having one end connected to the fuel valve and that forms a first passage;

a second tube that extends in the first direction, forms a second passage, and faces at least one of the plurality of burners;

a third tube that extends in the first direction, forms a third passage, and faces remaining burners of the plurality of burners; and a three-way valve connected to the first tube, the second tube, and the third tube, wherein the three-way valve guides fuel passing through the first passage to flow to the second passage and the third passage or to the third passage, wherein the plurality of burners comprises:

a first burner group with burners that faces the second tube; and a second burners group with burners that faces the third tube, wherein the three-way valve is positioned between the second tube and the third tube, wherein the gas furnace further comprises:

a flange that is connected to the plurality of burners between the plurality of burners and forms a flame propagation port;

a burner box that accommodates the plurality of burners and the flange;

an igniter mounted to the burner box and adjacent to an exit of a burner positioned farthest from the first burner group among the burners in the second burner group;

a flame detector mounted to the burner box and adjacent an exit of a burner positioned farthest from the second burner group among the burners in the first burner group; and an auxiliary detector mounted to the burner box and adjacent an exit of a burner positioned closest to the first burner group among the burners in the second burner group.

15. The gas furnace of claim 14, wherein the igniter, the flame detector, and the auxiliary detector are detachably mounted to the burner box.

16. An air conditioner having an outdoor unit and a ventilator that are connected to each other through a refrigerant pipe, wherein the ventilator comprises:

an air supply fan that causes a flow of air along an air supply passage;

an exhaust fan that causes a flow of air along an exhaust passage separated from the air supply passage;

a plurality of coils located in the air supply passage and having refrigerant flowing therethrough; and the gas furnace of claim 1, wherein the gas furnace is positioned downstream of the plurality of coils in the air supply passage.

* * * * *